US009569910B2

(12) United States Patent
Luo et al.

(10) Patent No.: US 9,569,910 B2
(45) Date of Patent: Feb. 14, 2017

(54) BANKNOTE PROCESSING DEVICE AND CASH-OUT AND CASH-IN MECHANISM THEREOF

(71) Applicant: GRG Banking Equipment Co., Ltd., Guangzhou, Guangdong (CN)

(72) Inventors: Panfeng Luo, Guangzhou (CN); Dong Tan, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/767,357

(22) PCT Filed: Jul. 8, 2013

(86) PCT No.: PCT/CN2013/078971

§ 371 (c)(1),
(2) Date: Aug. 12, 2015

(87) PCT Pub. No.: WO2014/153900

PCT Pub. Date: Oct. 2, 2014

(65) Prior Publication Data

US 2015/0371480 A1 Dec. 24, 2015

(30) Foreign Application Priority Data

Mar. 29, 2013 (CN) ..... 2013 1 0108591

(51) Int. Cl.

| | |
|---|---|
| ***B65H 31/06*** | (2006.01) |
| ***G07D 11/00*** | (2006.01) |
| ***B65H 29/40*** | (2006.01) |

(52) U.S. Cl.

CPC ..... *G07D 11/0021* (2013.01); *B65H 29/40* (2013.01); *B65H 31/06* (2013.01);

(Continued)

(58) Field of Classification Search

CPC ..... G07D 11/0018; G07D 11/0021; G07D 11/0012; G07D 11/0081; B65H 31/06; B65H 31/32; B65H 29/40; B65H 29/38; B65H 29/46; B65H 83/02; B65H 2701/1912

See application file for complete search history.

(56) References Cited

U.S. PATENT DOCUMENTS

| | | | | |
|---|---|---|---|---|
| 6,398,000 | B1 | 6/2002 | Jenrick et al. | |
| 7,677,545 | B2 * | 3/2010 | Iwami | B65H 1/025 271/153 |

(Continued)

FOREIGN PATENT DOCUMENTS

| | | |
|---|---|---|
| CN | 1796258 A | 7/2006 |
| CN | 1796259 A | 7/2006 |

(Continued)

OTHER PUBLICATIONS

International Search Report from corresponding International Application No. PCT/CN2013/078971 dated Jan. 9, 2014.

(Continued)

*Primary Examiner* — Luis A Gonzalez

(74) *Attorney, Agent, or Firm* — Wolf, Greenfield & Sacks, P.C.

(57) ABSTRACT

A banknote dispensing/receiving mechanism of a banknote processing device includes a housing and a baffle, the baffle is an elastic retaining piece, the elastic retaining piece has one end fixed with respect to the housing and another end being a free end, and the elastic retaining piece is located in the discharging route of banknotes. When the banknote dispensing/receiving mechanism operates, after the banknotes being discharged by a banknote-dispensing conveying mechanism, the banknotes fall onto the elastic retaining piece, and the elastic retaining piece provides a supporting force for the banknotes. When all the banknotes are (Continued)

discharged, the banknotes are pushed by a banknote pushing plate to apply a pushing force to the elastic retaining piece, and at this moment the elastic retaining piece generates a plastics deformation, which makes the banknotes and the banknote pushing plate pass through the elastic retaining piece together, to further perform subsequent operations.

18 Claims, 5 Drawing Sheets

(52) U.S. Cl.
CPC ..... *G07D 11/0018* (2013.01); *G07D 11/0081* (2013.01); *B65H 2701/1912* (2013.01)

(56) References Cited

U.S. PATENT DOCUMENTS

| | | | | |
|---|---|---|---|---|
| 2008/0156614 | A1* | 7/2008 | Park | G07D 11/0018 194/342 |
| 2011/0049797 | A1* | 3/2011 | Ohishi | B65H 29/52 271/264 |
| 2012/0193190 | A1* | 8/2012 | Yokote | G07D 11/0018 198/418 |
| 2014/0265107 | A1* | 9/2014 | Kang | B65H 29/52 271/216 |

FOREIGN PATENT DOCUMENTS

| | | | | |
|---|---|---|---|---|
| CN | 1881261 | A | | 12/2006 |
| CN | 1885353 | A | | 12/2006 |
| CN | 101211479 | A | | 7/2008 |
| CN | 101923747 | A | | 12/2010 |
| CN | 102087765 | A | | 6/2011 |
| CN | 102150184 | A | | 8/2011 |
| CN | 102745536 | A | | 10/2012 |
| CN | 103150810 | A | | 6/2013 |
| JP | 06312872 | A | * | 11/1994 |
| JP | 2000072311 | A | | 3/2000 |
| JP | 2000099795 | A | | 4/2000 |
| JP | 2010271887 | A | | 12/2010 |
| WO | WO 99/10846 | | | 4/1999 |
| WO | WO 2012/091438 | A2 | | 7/2012 |

OTHER PUBLICATIONS

Chinese Office Action dated Jul. 30, 2014 from corresponding Chinese Application No. 201310108591.X.

Chinese Office Action dated Mar. 9, 2015 from corresponding Chinese Application No. 201310108591.X.

Extended European Search Report, dated Mar. 7, 2016, from corresponding European Application No. 13879763.4.

* cited by examiner

BANKNOTE PROCESSING DEVICE AND CASH-OUT AND CASH-IN MECHANISM THEREOF

This application is the national phase of International Application No. PCT/CN2013/078971, titled "BANKNOTE PROCESSING DEVICE AND CASH-OUT AND CASH-IN MECHANISM THEREOF", filed on Jul. 8, 2013, which claims the benefit of priority to Chinese Patent Application No. 201310108591.X titled "BANKNOTE PROCESSING DEVICE AND BANKNOTE DISPENSING/RECEIVING MECHANISM THEREOF", filed with the Chinese State Intellectual Property Office on Mar. 29, 2013, each of which applications is incorporated herein by reference to the maximum extent allowable by law.

TECHNICAL FIELD

The present application relates to the field of banknote processing technique, and particularly to a banknote dispensing/receiving mechanism of a banknote processing device. The present application further relates to a banknote processing device having the banknote dispensing/receiving mechanism.

BACKGROUND

With the continuous development of economy, the processing amount of banknotes is continuously increased, and the requirement for processing capacity of the banknote processing device is increased accordingly. At present, main functions of the widely used banknote processing device include banknote withdrawing, banknote depositing, bank transfer and etc., and in these operations, the banknote processing device mainly uses a banknote dispensing/receiving mechanism to receive and dispense banknotes.

The banknote dispensing/receiving mechanism mainly includes a housing, a baffle, a side plate, a bottom plate, a pressing plate, a banknote pushing plate, a banknote separating mechanism and a banknote-dispensing conveying mechanism. The housing is a mounting foundation for the banknote dispensing/receiving mechanism. The baffle is arranged on the housing, and is movable upward and downward. The pressing plate is configured to support banknotes, and the pressing plate and the banknote pushing plate are both movable with respect to the bottom plate. The banknote separating mechanism and the banknote-dispensing conveying mechanism are respectively located at two sides of the bottom plate, and the banknote separating mechanism generally employs a banknote separating wheel. The banknote pushing plate is located on the pressing plate at one end close to the banknote-dispensing conveying mechanism. When a customer performs a banknote depositing operation, the customer places the banknotes in a space enclosed by the housing, the bottom plate and the pressing plate, then the banknote separating mechanism separates the banknotes into single sheets to be conveyed. After the single sheets of banknotes pass through a banknote identification unit, qualified banknotes are delivered into a banknote temporary storage device and unqualified banknotes are delivered to the banknote-dispensing conveying mechanism, and then the unqualified banknotes are conveyed by the banknote-dispensing conveying mechanism into a space formed between the bottom plate and the baffle. When the customer performs a banknote withdrawing operation, banknotes in a cash box are delivered along a banknote conveying passage to pass through the banknote identification unit and the banknote-dispensing conveying mechanism and then are stacked in the space formed between the bottom plate and the baffle. After all the banknotes to be dispensed are stacked, the pressing plate moves to a vicinity of the baffle, the baffle may move upward or downward to cooperate with the banknote pushing plate to push the banknotes to a banknote dispensing/receiving port.

When the baffle needs to move, a power mechanism including a motor, a belt and a gear or other parts are employed to drive the baffle, which may complicate the structure of the whole banknote dispensing/receiving mechanism. Besides, the banknote-dispensing conveying mechanism mainly includes the banknote separating wheel, and a complex mechanism is required to drive the banknote separating wheel to operate, which may similarly complicate the structure of the banknote dispensing/receiving mechanism.

In conclusion, a technical problem to be solved by those skilled in the art is to solve the problem that the banknote dispensing/receiving mechanism of the banknote processing device has a complicated structure.

SUMMARY

An object of the present application is to provide a banknote dispensing/receiving mechanism of a banknote processing device, and the banknote dispensing/receiving mechanism has a simple structure. Another object of the present application is to provide a banknote processing device having the banknote dispensing/receiving mechanism.

For realizing the above objects, the following technical solutions are provided according to the present application.

A banknote dispensing/receiving mechanism of a banknote processing device includes a housing and a baffle, wherein the baffle is an elastic retaining piece, one end of the elastic retaining piece is fixed with respect to the housing and another end of the elastic retaining piece is a free end, and the elastic retaining piece is located in a discharging route of banknotes.

Preferably, in the banknote dispensing/receiving mechanism, the elastic retaining piece includes a first retaining piece and a second retaining piece, a fixed end of the first retaining piece is arranged oppositely to a fixed end of the second retaining piece, and a free end of the first retaining piece and a free end of the second retaining piece are both located in the discharging route of the banknotes.

Preferably, in the banknote dispensing/receiving mechanism, a surface of the first retaining piece facing a banknote pushing plate of the banknote dispensing/receiving mechanism and a surface of the second retaining piece facing the banknote pushing plate are at a same plane.

Preferably, in the banknote dispensing/receiving mechanism, a banknote-dispensing conveying mechanism of the banknote dispensing/receiving mechanism includes a vane wheel, and a banknote pushing plate of the banknote dispensing/receiving mechanism is configured to be located at a side of vanes of the vane wheel to form a banknote blocking mechanism.

Preferably, in the banknote dispensing/receiving mechanism, a curve-shaped banknote blocking slit is provided between a bottom portion of a pressing plate of the banknote dispensing/receiving mechanism and/or a bottom portion of a banknote pushing plate of the banknote dispensing/receiving mechanism, and a bottom plate of the banknote dispensing/receiving mechanism.

Preferably, in the banknote dispensing/receiving mechanism, the curve-shaped banknote blocking slit is a rectangle corrugated banknote blocking slit.

Preferably, in the banknote dispensing/receiving mechanism, a pressing plate of the banknote dispensing/receiving mechanism is provided with a banknote separating wheel accommodating groove, and a banknote separating wheel of the banknote dispensing/receiving mechanism is configured to pass through the banknote separating wheel accommodating groove, to form a banknote contacting portion exposed out of the banknote separating wheel accommodating groove.

Preferably, in the banknote dispensing/receiving mechanism, the housing is provided with a first guide slot, and a pressing plate of the banknote dispensing/receiving mechanism is in a sliding fit with the housing via the first guide slot.

Preferably, in the banknote dispensing/receiving mechanism, the housing is provided with a second guide slot, and a banknote pushing plate of the banknote dispensing/receiving mechanism is in a sliding fit with the housing via the second guide slot.

In the above technical solutions, the banknote dispensing/receiving mechanism of the banknote processing device according to the present application includes the housing and the baffle, the baffle is the elastic retaining piece, one end of the elastic retaining piece is fixed with respect to the housing, and another end of the elastic retaining piece is a free end, and the elastic retaining piece is located in the discharging route of banknotes. When the banknote dispensing/receiving mechanism operates, after the banknotes being discharged by the banknote-dispensing conveying mechanism, the banknotes fall onto the elastic retaining piece, and the elastic retaining piece provides a supporting force for the banknotes. When all the banknotes are discharged, the banknotes are pushed by the banknote pushing plate to apply a pushing force to the elastic retaining piece, and at this moment the elastic retaining piece generates a plastics deformation, which makes the banknotes and the banknote pushing plate pass through the elastic retaining piece together, or makes the banknote pushing plate return to an initial position via the elastic retaining piece, to further perform the subsequent operations.

Based on the above description, in the banknote dispensing/receiving mechanism provided by the present application, the baffle is embodied as the elastic retaining piece, thus compared with the content introduced in the background technology, when the banknotes pass through the baffle, a driving mechanism is not required to drive the baffle to rise and fall, and the banknotes can pass through smoothly by only relying on the elastic deformation of the elastic retaining piece. Obviously, the above banknote dispensing/receiving mechanism omits the driving mechanism for driving the baffle to rise and fall, thus having a simple structure.

A banknote processing device is further provided by the present application, which includes a banknote dispensing/receiving mechanism, the banknote dispensing/receiving mechanism is any one of the above banknote dispensing/receiving mechanisms. Since the above banknote dispensing/receiving mechanism has the above technical effects, the banknote processing device having the banknote dispensing/receiving mechanism should also have the corresponding technical effects.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

Figure 1:
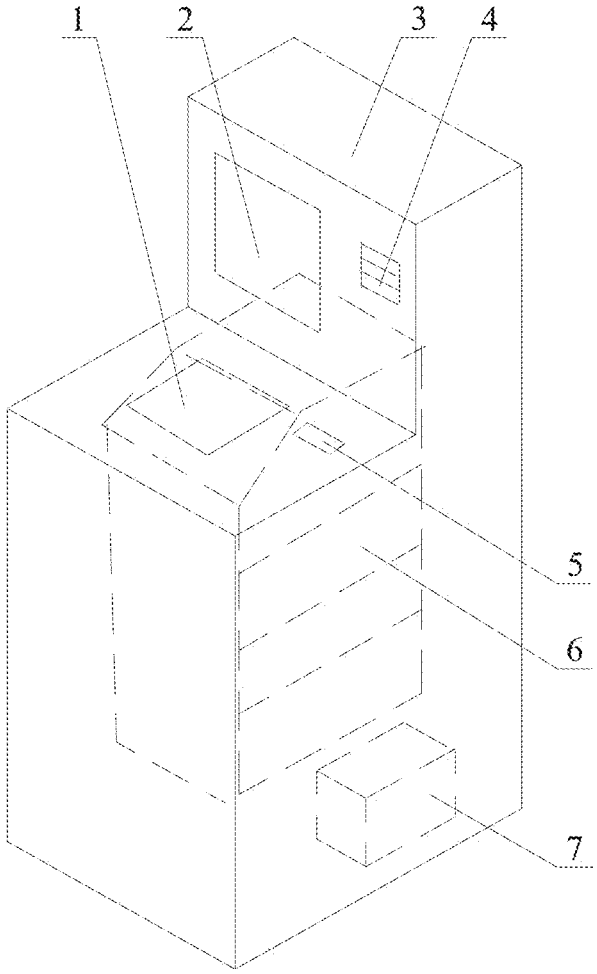
FIG. 1 is a schematic view showing the structure of a banknote processing device.

Reference numerals in FIGS. 1 to 8:

| | | | |
|---|---|---|---|
| 1 | cash dispensing/receiving port, | 2 | display unit, |
| 3 | housing, | 4 | card and detailed statement processing unit, |
| 5 | input unit, | 6 | banknote processing unit, |
| 7 | main body controller; | | |
| 11 | banknote dispensing/receiving mechanism, | 12 | banknote identification unit, |
| 13 | banknote conveying passage, | 14 | banknote temporary storage device, |
| 15 | cash container, | 16 | depositing cash box, |
| 17 | recycling cash box, | 21 | side plate, |
| 22 | banknote dispensing/receiving port, | 23 | first guide slot, |
| 24 | first retaining piece, | 25 | housing, |
| 26 | banknote-dispensing conveying passage, | 27 | vane wheel, |
| 28 | banknote pushing plate, | 29 | bottom plate, |
| 30 | second guide slot, | 31 | second retaining piece, |
| 32 | pressing plate, | 33 | banknote separating wheel, |
| 34 | banknote-receiving conveying passage. | | |

DETAILED DESCRIPTION

The core of the present application is to provide a banknote dispensing/receiving mechanism of a banknote processing device, and the banknote dispensing/receiving mechanism has a simple structure. Another core of the present application is to provide a banknote processing device having the banknote dispensing/receiving mechanism.

For those skilled in the art to better understand technical solutions of the present application, the present application is described in detail in conjunction with drawings and embodiments hereinafter.

A banknote dispensing/receiving mechanism of a banknote processing device is provided according to an embodiment of the present application, and can be applied in banknote processing devices such as an automatic cash dispenser and an automatic teller machine. The structure of the banknote dispensing/receiving mechanism according to the embodiment of the present application is described in detail by taking the banknote dispensing/receiving mechanism used in the automatic teller machine as an example.

Referring to FIG. 1, the automatic teller machine includes a display unit 2, a shell 3, a card and detailed statement processing unit 4, an input unit 5, a banknote processing unit 6 and a main body controller 7, and the shell 3 includes a banknote dispensing/receiving port 1. The display unit 2 is configured to display an image containing detailed information of various kinds of transactions and options and etc. The shell 3 is an installation base for the whole automatic teller machine. The card and detailed statement processing unit 4 is mainly used for reading information of cards and issuing detailed statements. The input unit 5 is a device for users to input necessary information, and mainly includes a keyboard and etc. The banknote processing unit 6 is used to receive banknotes placed into the cash dispensing/receiving port 1 or dispense banknotes via the cash dispensing/receiving port 1 according to the cash withdrawing or depositing operation of the user. The main body controller 7 is configured to control the automatic teller machine on the whole, and to accurately control the operation states of each part in the automatic teller machine mainly by processing signals sent from sensors.

Figure 2:
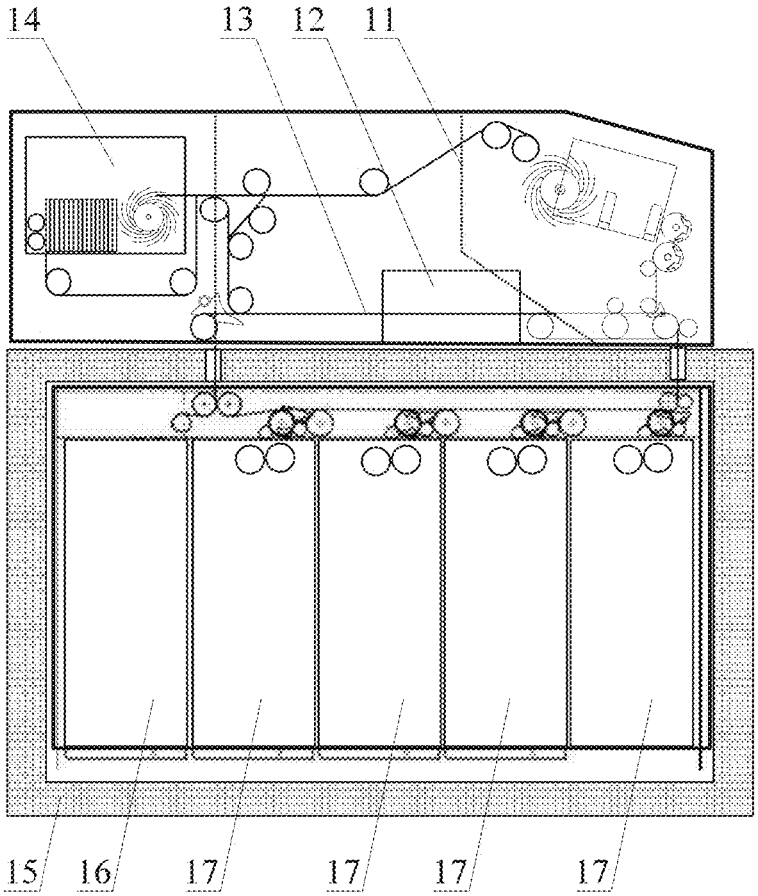
FIG. 2 is a schematic view showing the structure of a banknote processing unit.

As shown in FIG. 2, the banknote processing unit 6 mainly includes a banknote dispensing/receiving mechanism 11, a banknote identification unit 12, a banknote conveying passage 13, a banknote temporary storage device 14, a cash container 15, a depositing cash box 16 and a recycling cash box 17, and the depositing cash box 16 and the recycling cash box 17 are both arranged inside the cash container 15. During the banknote depositing process, a customer first puts banknotes inside the banknote dispensing/receiving mechanism 11, the banknotes inside the banknote dispensing/receiving mechanism 11 are delivered into the banknote identification unit 12 via the banknote conveying passage 13, the banknotes identified to be qualified are delivered into the banknote temporary storage device 14 and the banknotes identified to be unqualified are returned into the banknote dispensing/receiving mechanism 11 and then returned to the customer. After all of the banknotes are identified, the qualified banknotes inside the banknote temporary storage device 14 are conveyed through the banknote conveying passage, passes through a conveying port on the cash container 15 and enter into the depositing cash box 16. When the customer needs to withdraw money, banknotes inside the recycling cash box 17 are conveyed to the banknote identification unit 12, and are then conveyed into the banknote dispensing/receiving mechanism 11, and finally are withdrawn by the customer. Of course, in practical implementation, the depositing cash box 16 and the recycling cash box 17 are interchangeably used, the number of both of the depositing cash box 16 and the recycling cash box 17 can be set flexibly according to specific application occasions.

Figure 3:
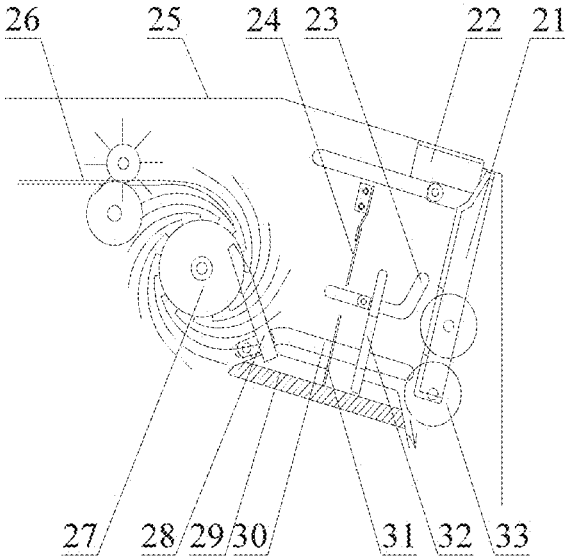
FIG. 3 is a schematic view showing the structure of a banknote dispensing/receiving mechanism according to an embodiment of the present application.
Figure 4:
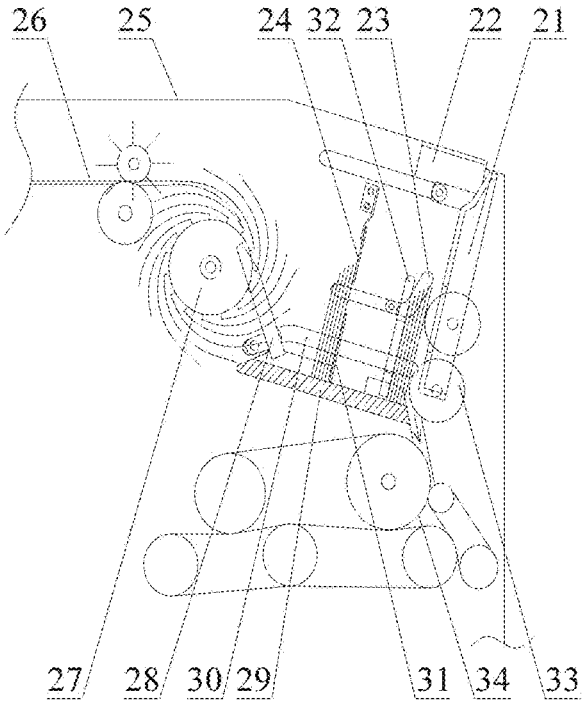
FIG. 4 is a schematic view showing the structure of the banknote dispensing/receiving mechanism according to the embodiment of the present application when the banknote dispensing/receiving mechanism is conveying banknotes to be received.

As shown in FIGS. 3 and 4, the banknote dispensing/receiving mechanism according to the embodiment of the present application mainly includes a housing 25, a side plate 21, a banknote-receiving conveying passage 34, a banknote separating mechanism, a banknote-dispensing conveying passage 26, a banknote-dispensing conveying mechanism, a banknote pushing plate 28, a bottom plate 29 and a pressing plate 32, and the housing 25 is provided with a banknote dispensing/receiving port 22. The housing 25 is an installation base of the whole banknote dispensing/receiving mechanism, and the side plate 21, the banknote-receiving conveying passage 34, the banknote separating mechanism, the banknote-dispensing conveying passage 26, the banknote-dispensing conveying mechanism, the banknote pushing plate 28, the bottom plate 29, a baffle and the pressing plate 32 are all arranged on the housing 25. The side plate 21 is configured to position the banknote separating mechanism, and meanwhile to limit the position of the banknotes placed into the banknote dispensing/receiving mechanism by the customer. The banknote-receiving conveying passage 34 is mainly composed of conveying wheels, and these conveying wheels are driven by a driving device to rotate. The banknote separating mechanism is configured to separate a whole stack of banknotes into single sheets of banknotes to facilitate conveying the banknotes, and generally adopts a banknote separating wheel 33. The banknote-dispensing conveying passage 26 is configured to convey the banknotes to be withdrawn by the customer or identified to be unqualified by the banknote identification unit to the banknote dispensing/receiving port 22. The banknote-dispensing conveying mechanism is arranged adjacent to the banknote-dispensing conveying passage 26, and is configured to convey the banknotes from the banknote-dispensing conveying passage 26 to the bottom plate 29 and then retain the banknotes by the baffle, and the banknote-dispensing conveying mechanism may employ a banknote separating wheel mechanism. The banknote pushing plate 28 and the pressing plate 32 can both be driven by the driving device to move with respect to the bottom plate 29, and specifically, the banknote pushing plate 28 and the pressing plate 32 are in a sliding fit with the bottom plate 29.

Figure 5:
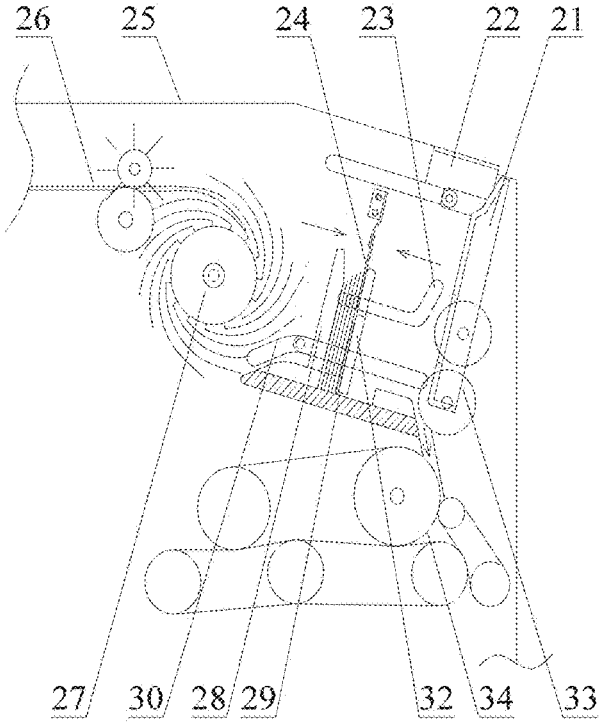
FIG. 5 is a schematic view showing the structure of the banknote dispensing/receiving mechanism according to the embodiment of the present application when the banknote dispensing/receiving mechanism is conveying banknotes to be returned.
Figure 6:
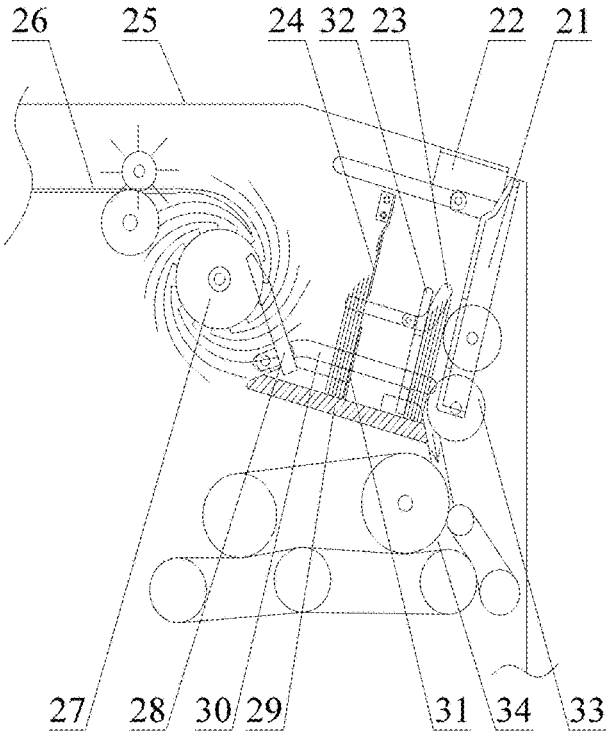
FIG. 6 is a schematic view showing the structure of the banknote dispensing/receiving mechanism according to the embodiment of the present application when the banknotes to be returned are conveyed to a banknote dispensing/receiving port.

As shown in FIG. 4, when the customer needs to deposit money, a gate at the banknote dispensing/receiving port 22 is opened, the customer places the banknotes in a space enclosed by the side plate 21, the bottom plate 29 and the pressing plate 32, and after all the banknotes are placed in the space, the pressing plate 32 presses the banknotes, a pressure sensor at the position of the banknote separating wheel 33 sends a signal to enable the banknote separating wheel 33 enter into an operating state, the banknote separating wheel 33 separates the banknotes into single sheets, and the singe sheets of banknotes are continually conveyed by the banknote-receiving conveying passage 34 into the banknote identification unit. After the banknotes are identified, unqualified banknotes are delivered to a space formed between the bottom plate 29 and the baffle through the banknote-dispensing conveying passage 26 and the banknote-dispensing conveying mechanism, and at this time, the banknote pushing plate 28 is at a side close to the banknote-dispensing conveying mechanism. As shown in FIGS. 5 and 6, after all of the banknotes are identified, the pressing plate 32 and the banknote pushing plate 28 both move toward the baffle, and when the pressing plate 32 reaches the baffle, the sensor sends a signal to make the pressing plate 32 stop moving, while the banknote pushing plate 28 continues to move. When the banknote pushing plate 28 pushes the banknotes to come into contact with the pressing plate 32, the pressing plate 32 moves toward the side plate 21 in the moving direction of the banknote pushing plate 28. The banknote separating wheel 33 is arranged on the side plate 21, thus when the pressing plate 32 comes into contact with the banknote separating wheel 33, the pressure sensor at the position of the banknote separating wheel 33 sends a signal to make the banknote pushing plate 28 and the pressing plate 32 both stop moving, and at the same time, the gate at the banknote dispensing/receiving port 22 may be opened to allow the customer to take back the unqualified banknotes.

When the customer needs to deposit money, banknotes inside the recycling cash box directly enter into the banknote identification unit, the qualified banknotes may be delivered into the space formed between the baffle and the bottom plate 29 via the banknote-dispensing conveying passage and the banknote-dispensing conveying mechanism, and the remaining process is similar to the banknote depositing process, thus will not be described in detail herein.

The key improvement point of the present application is that the baffle is an elastic retaining piece, and the elastic retaining piece may be a whole piece having one end fixed with respect to the housing 25 and another end being a free end. The free end of the elastic retaining piece can be bent when subjected to an external force, and the elastic retaining piece is located in a discharging route of the banknotes, and the discharging route refers to a distance of banknotes moving to the banknote dispensing/receiving port 22 after being discharged by the banknote-dispensing conveying mechanism.

In the operating process of the banknote dispensing/receiving mechanism, after being discharged by the banknote-dispensing conveying mechanism, the banknotes will fall onto the elastic retaining piece, and the elastic retaining piece provides a supporting force for the banknotes; after the banknotes are all discharged, the banknotes apply a pushing force to the elastic retaining piece under the action of a pushing force of the banknote pushing plate 28, and at this time, the elastic retaining piece may generate a plastic deformation, which makes the banknotes and the banknote pushing plate 28 pass through the elastic retaining piece together and then move toward the side plate 21 with the pressing plate 32, or makes the banknote pushing plate 28 return to the initial position to further perform the subsequent operations.

According to the above description, in the banknote dispensing/receiving mechanism according to the embodiments of the present application, the baffle is embodied as the elastic retaining piece, thus compared with the content introduced in the background technology, when the banknotes pass through the baffle, there is no need to employ a driving mechanism to drive the baffle to rise and fall, and the banknotes and the banknote pushing plate can pass through smoothly by just relying on the elasticity of the elastic retaining piece. Obviously, the banknote dispensing/receiving mechanism without the driving mechanism has a simple structure.

As shown in FIGS. 3 to 6, in a further technical solution, the elastic retaining piece includes a first retaining piece 24 and a second retaining piece 31, and a fixed end of the first retaining piece 24 is arranged oppositely to a fixed end of the second retaining piece 31. Specifically, the first retaining piece 24 may be directly fixed at a top of the housing and the second retaining piece 31 is directly fixed on the bottom plate 29. A free end of the first retaining piece 24 and a free end of the second retaining piece 31 are both located in the discharging route of the banknotes, that is, after being discharged by the banknote-dispensing conveying mechanism, the banknotes may be retained by the first retaining piece 24 and the second retaining piece 31. Compared with the structure of the elastic retaining piece being embodied as a whole piece, the first retaining piece 24 and the second retaining piece 31 are respectively fixed, thus the fixing strength of the whole elastic retaining piece is improved, and the elastic retaining piece can provide a greater supporting force for the banknotes. Meanwhile, the height of each of the first retaining piece 24 and the second retaining piece 31 is lower than the height of the whole piece of the elastic retaining piece, which facilitates the banknotes passing through smoothly. Specifically, the first retaining piece 24 and the second retaining piece 31 may be made from polyester film, the first retaining piece 24 may be adhered to a metal plate, the metal plate is fixed to the housing 25 via a fastener such as screws, and the second retaining piece 31 may be directly adhered to the bottom plate 29.

When the elastic retaining piece is not subjected to an external force, that is in a natural state, the first retaining piece 24 and the second retaining piece 31 may be arranged in staggeredly, that is, the banknotes come into contact with the first retaining piece 24 and the second retaining piece 31 in a certain sequence; considering that in this manner, the first retaining piece 24 and the second retaining piece 31 cannot apply the supporting force to the banknotes at the same time, in the embodiment of the present application, it is preferable that, in the natural state, a surface of the first retaining piece 24 facing the banknote pushing plate 28 and a surface of the second retaining piece 31 facing the banknote pushing plate 28 are at a same plane, and the plane is determined by the movement track of the banknotes, to allow the banknotes to come into contact with the first retaining piece 24 and the second retaining piece 31 simultaneously, thus the first retaining piece 24 and the second retaining piece 31 may provide a reliable supporting force for the banknotes.

In a further technical solution, the banknote-dispensing conveying mechanism of the banknote dispensing/receiving mechanism according to the embodiment of the present application includes a vane wheel 27, multiple vanes on the vane wheel 27 can be used to convey the banknotes, and the banknote pushing plate 28 may be located at a side of the vanes of the vane wheel 27 to form a banknote blocking mechanism. The banknotes rotate along with the vanes of the vane wheel 27, and when the banknotes come into contact with the banknote pushing plate 28, the banknote pushing plate 28 stops the banknotes from rotating along with the vanes and makes the banknotes slide along the bottom plate 29 toward the elastic retaining piece. Compared with the solution of employing the banknote separating wheel mechanism as the banknote-dispensing conveying mechanism, the vane wheel 27 does not need a complex driving mechanism, and it is only required to transfer the torsion of a power source directly to a rotation shaft of the vane wheel 27. Obviously, by using the vane wheel, the structure of the whole banknote dispensing/receiving mechanism is simplified.

Figure 7:
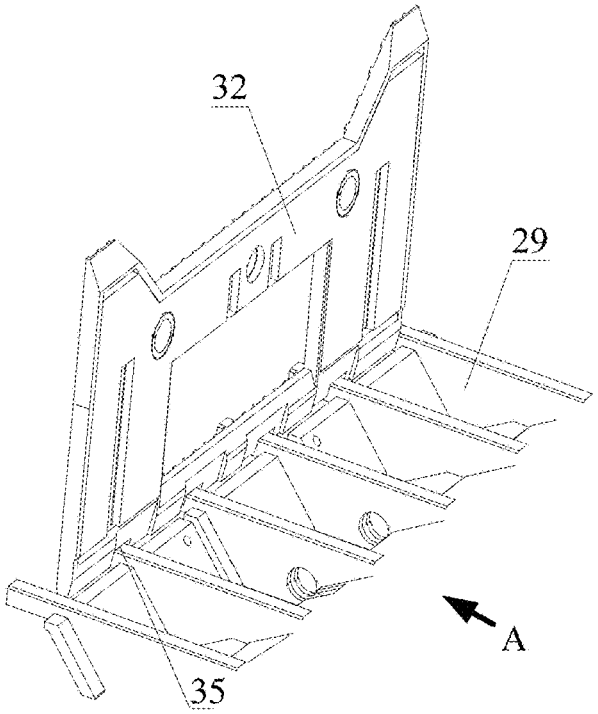
FIG. 7 is a schematic view showing the assembly structure of a bottom plate and a pressing plate according to the embodiment of the present application.
Figure 8:
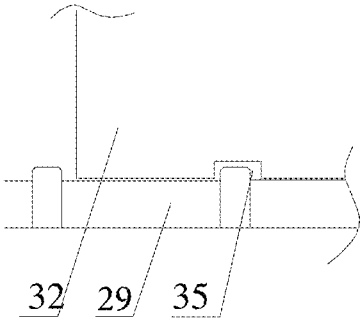
FIG. 8 is a partially enlarged view of FIG. 7 viewed in a direction A.

To prevent the banknotes from passing through a clearance between the pressing plate 32 and the bottom plate 29 when the banknotes are subjected to the pressure of the pressing plate 32, a curve-shaped banknote blocking slit 35 is provided between a bottom of the pressing plate 32 and the bottom plate 29. As shown in FIGS. 7 and 8, specifically, the bottom surface of the pressing plate 32 and an upper surface of the bottom plate 29 are both embodied as a curved surface, thereby forming the curve-shaped banknote blocking slit 35 between the pressing plate 32 and the bottom plate 29. It can be appreciated that, when a lower edge of the banknote is in the clearance between the pressing plate 32 and the bottom plate 29, the curve-shaped banknote blocking slit 35 may stop the banknote from passing through the clearance between the pressing plate 32 and the bottom plate 29. Similarly, the clearance between the bottom of the banknote pushing plate 28 and the bottom plate 29 may be set as the curve-shaped banknote blocking clearance.

In practical application, the curve-shaped banknote blocking slit 35 may be a wave-shaped banknote blocking slit or a zigzag banknote blocking slit, and etc. For facilitating machining, a rectangular corrugated banknote blocking slit is employed in the embodiment of the present application. As shown in FIGS. 7 and 8, the bottom of the pressing plate 32 and/or the bottom of the banknote pushing plate 28, and the bottom plate 29 are respectively provided with rectangular protrusions and rectangular grooves for containing the rectangular protrusions.

In a preferred technical solution, a banknote separating wheel accommodating groove is provided on the pressing plate 32, and when the pressing plate 32 is at a tail end of the route, the banknote separating wheel 33 passes through the banknote separating wheel accommodating groove, to form a banknote contacting portion exposed out of the banknote separating wheel accommodating groove. When the banknote pushing plate 28, the banknotes and the pressing plate 32 move toward the banknote separating wheel 33 together, the banknote separating wheel accommodating groove on the pressing plate 32 gradually passes through the edge of the banknote separating wheel 33, and when the banknotes come into contact with the banknote contacting portion of the banknote separating wheel 33, the pressure sensor sends a signal to make the pressing plate 32 and the banknote pushing plate 28 stop moving. In general case, if the banknote pushing plate 28 and the pressing plate 32 are controlled to stop moving after the pressing plate 32 comes into contact with the banknote separating wheel 33, a situation of the banknotes being scattered between the banknote pushing plate 28 and the pressing plate 32 is tend to occur due to the influence of factors such as the difference of moving speeds of the banknote pushing plate 28 and the pressing plate 32, and the difference in the number of the banknotes. In this case, even if the pressing plate 32 stops moving after coming into contact with the banknote separating wheel 33, the states of the banknotes make it hard for the customer to take away the banknotes. The arrangement of the banknote separating wheel accommodating groove makes the banknote pushing plate 28 and the pressing plate 32 stop moving only when the force applied to the banknote separating wheel 33 by the banknotes reaches a predetermined value, obviously, this manner makes the banknotes to be aligned when the banknote pushing plate 28 and the pressing plate 32 apply enough pressure to the banknotes, thus it is easy for the customer to take away the banknotes.

In order to improve the movement accuracy of the pressing plate 32, a first guide slot 23 may be provided on the housing 25, and the pressing plate 32 is in a sliding fit with the housing 25 via the first guide slot 23. Preferably, the pressing plate 32 is in a sliding fit with the first guide slot 23 via a bearing, and a guide block and a guide shaft are arranged on the pressing plate 32. Under the action of a driving device, the pressing plate 32 moves strictly along the track of the first guide slot 23, to prevent situations such as the pressing plate 32 being shaking in the moving process. Situations of operation timeout or even forgetting to take back the banknotes are hard to avoid when the customer performs operations, in this case, banknotes located between the banknote pushing plate 28 and the pressing plate 32 need to be conveyed into the banknote temporary device again. Accordingly, a tail end of the first guide slot 23 may incline upward, to lift the pressing plate 32 upward by a certain distance when the pressing plate 32 moves to a position close to the banknote separating wheel 33, thus a large gap may be formed between the bottom of the pressing plate 32 and the bottom plate 29, to allow the banknotes to move to the banknote-receiving conveying passage under the action of the banknote separating wheel 33. Besides, the upward inclining and stretching of the tail end of the first guide slot 23 may also facilitate arranging the sensor cooperating with the pressing plate 32.

Similarly, a second guide slot 30 may be provided on the housing 25, and the banknote pushing plate 28 of the banknote dispensing/receiving mechanism is in a sliding fit with the housing 25 via the second guide slot 30. The banknote pushing plate 28 may similarly in a sliding fit with the second guide slot 30 via a bearing, and a guide block and a guide shaft are provided on the banknote pushing plate 28. When the banknote-dispensing conveying mechanism adopts the vane wheel 27, the banknote pushing plate 28 needs to be obliquely arranged to form a banknote blocking mechanism, therefore, a head end of the second guide slot 30 is also obliquely arranged.

A banknote processing device is further provided by embodiments of the present application, which includes a banknote dispensing/receiving mechanism, and the banknote dispensing/receiving mechanism is the banknote dispensing/receiving mechanism described in any one of the above technical solutions. Since the banknote dispensing/receiving mechanism has the above technical effects, the banknote processing device having the banknote dispensing/receiving mechanism should also have corresponding technical effects, which will not be described in detail herein.

The banknote processing device and the banknote dispensing/receiving mechanism thereof provided by the present application are described in detail hereinbefore. The principle and the embodiments of the present application are illustrated herein by specific examples. The above description of examples is only intended to help the understanding of the method and the spirit of the present application. It should be noted that, for the person skilled in the art, a few of improvements and modifications may be made to the present application without departing from the principle of the present application, and these improvements and modifications are also deemed to fall into the scope of the present application defined by the claims.

The invention claimed is:

1. A banknote dispensing/receiving mechanism of a banknote processing device, comprising a housing and a baffle, wherein the baffle is an elastic retaining piece, one end of the elastic retaining piece is fixed with respect to the housing and another end of the elastic retaining piece is a free end, and the elastic retaining piece is located in a discharging route of banknotes, wherein the elastic retaining piece comprises a first retaining piece and a second retaining piece, a fixed end of the first retaining piece is arranged oppositely to a fixed end of the second retaining piece, and a free end of the first retaining piece and a free end of the second retaining piece are both located in the discharging route of the banknotes.

2. The banknote dispensing/receiving mechanism according to claim 1, wherein a surface of the first retaining piece facing a banknote pushing plate of the banknote dispensing/ receiving mechanism and a surface of the second retaining piece facing the banknote pushing plate are at a same plane.

3. The banknote dispensing/receiving mechanism according to claim 1, wherein a banknote-dispensing conveying mechanism of the banknote dispensing/receiving mechanism comprises a vane wheel, and a banknote pushing plate of the banknote dispensing/receiving mechanism is configured to be located at a side of vanes of the vane wheel to form a banknote blocking mechanism.

4. The banknote dispensing/receiving mechanism according to claim 1, wherein a curve-shaped banknote blocking slit is provided between a bottom portion of a pressing plate of the banknote dispensing/receiving mechanism and/or a bottom portion of a banknote pushing plate of the banknote dispensing/receiving mechanism, and a bottom plate of the banknote dispensing/receiving mechanism.

5. The banknote dispensing/receiving mechanism according to claim 4, wherein the curve-shaped banknote blocking slit is a rectangle corrugated banknote blocking slit.

6. The banknote dispensing/receiving mechanism according to claim 1, wherein a pressing plate of the banknote dispensing/receiving mechanism is provided with a banknote separating wheel accommodating groove, and a banknote separating wheel of the banknote dispensing/receiving mechanism is configured to pass through the banknote separating wheel accommodating groove, to form a banknote contacting portion exposed out of the banknote separating wheel accommodating groove.

7. The banknote dispensing/receiving mechanism according to claim 1, wherein the housing is provided with a first guide slot, and a pressing plate of the banknote dispensing/receiving mechanism is in a sliding fit with the housing via the first guide slot.

8. The banknote dispensing/receiving mechanism according to claim 7, wherein the housing is provided with a second guide slot, and a banknote pushing plate of the banknote dispensing/receiving mechanism is in a sliding fit with the housing via the second guide slot.

9. The banknote dispensing/receiving mechanism according to claim 1, wherein a pressing plate of the banknote dispensing/receiving mechanism is provided with a banknote separating wheel accommodating groove, and a banknote separating wheel of the banknote dispensing/receiving mechanism is configured to pass through the banknote separating wheel accommodating groove, to form a banknote contacting portion exposed out of the banknote separating wheel accommodating groove.

10. The banknote dispensing/receiving mechanism according to claim 2, wherein the housing is provided with a first guide slot, and a pressing plate of the banknote dispensing/receiving mechanism is in a sliding fit with the housing via the first guide slot.

11. The banknote dispensing/receiving mechanism according to claim 10, wherein the housing is provided with a second guide slot, and a banknote pushing plate of the banknote dispensing/receiving mechanism is in a sliding fit with the housing via the second guide slot.

12. A banknote processing device, comprising a banknote dispensing/receiving mechanism, wherein the banknote dispensing/receiving mechanism comprises a housing and a baffle, the baffle is an elastic retaining piece, one end of the elastic retaining piece is fixed with respect to the housing and another end of the elastic retaining piece is a free end, and the elastic retaining piece is located in a discharging route of banknotes, wherein the elastic retaining piece comprises a first retaining piece and a second retaining piece, a fixed end of the first retaining piece is arranged oppositely to a fixed end of the second retaining piece, and a free end of the first retaining piece and a free end of the second retaining piece are both located in the discharging route of the banknotes.

13. The banknote processing device according to claim 12, wherein a surface of the first retaining piece facing a banknote pushing plate of the banknote dispensing/receiving mechanism and a surface of the second retaining piece facing the banknote pushing plate are at a same plane.

14. The banknote processing device according to claim 12, wherein a banknote-dispensing conveying mechanism of the banknote dispensing/receiving mechanism comprises a vane wheel, and a banknote pushing plate of the banknote dispensing/receiving mechanism is configured to be located at a side of vanes of the vane wheel to form a banknote blocking mechanism.

15. The banknote processing device according to claim 12, wherein a curve-shaped banknote blocking slit is provided between a bottom portion of a pressing plate of the banknote dispensing/receiving mechanism and/or a bottom portion of a banknote pushing plate of the banknote dispensing/receiving mechanism, and a bottom plate of the banknote dispensing/receiving mechanism.

16. The banknote processing device according to claim 12, wherein a pressing plate of the banknote dispensing/receiving mechanism is provided with a banknote separating wheel accommodating groove, and a banknote separating wheel of the banknote dispensing/receiving mechanism is configured to pass through the banknote separating wheel accommodating groove, to form a banknote contacting portion exposed out of the banknote separating wheel accommodating groove.

17. The banknote processing device according to claim 12, wherein the housing is provided with a first guide slot, and a pressing plate of the banknote dispensing/receiving mechanism is in a sliding fit with the housing via the first guide slot.

18. The banknote processing device according to claim 17, wherein the housing is provided with a second guide slot, and a banknote pushing plate of the banknote dispensing/receiving mechanism is in a sliding fit with the housing via the second guide slot.

* * * * *